US006062706A

United States Patent [19]

Owen

[11] Patent Number: 6,062,706

[45] Date of Patent: May 16, 2000

[54] VARIABLE COLOR FLUORESCENT LIGHTING

[75] Inventor: Keith Owen, Birmingham, United Kingdom

[73] Assignee: Light & Sound Design, Ltd., United Kingdom

[21] Appl. No.: 09/041,100

[22] Filed: Mar. 9, 1998

[51] Int. Cl.[7] ..... F21V 9/00; F21V 23/00

[52] U.S. Cl. ..... 362/231; 362/235; 362/295

[58] Field of Search ..... 362/11, 217, 223, 362/224, 231, 235, 255, 260, 295

[56] References Cited

U.S. PATENT DOCUMENTS

| | | | |
|---|---|---|---|
| 2,337,833 | 12/1943 | Pahl | 362/231 |
| 3,733,480 | 5/1973 | Glenn | 362/224 |
| 4,692,795 | 9/1987 | Nakao | 362/231 |
| 5,060,118 | 10/1991 | Penrod et al. | 362/295 |
| 5,235,497 | 8/1993 | Costa | 362/224 |
| 5,722,755 | 3/1998 | Slape | 362/231 |

*Primary Examiner*—Sandra O'Shea
*Assistant Examiner*—Peggy G. Neils
*Attorney, Agent, or Firm*—Fish & Richardson P.C.

[57] ABSTRACT

Three primary colored flourescent bulbs are selectively dimmed according to a ratio which produces a desired color, and at a brightness as desired.

10 Claims, 1 Drawing Sheet

VARIABLE COLOR FLUORESCENT LIGHTING

BACKGROUND

It is often desirable in stage lighting applications to provide a backlighting backdrop for the scene also called a "cyclorama" or simply "cyc". Such a lighting backdrop is often effected by incandescent lights which are desirably colored. The change of color allows, for example, any desired white balance for the background.

A common color changing medium used for such backlighting is a graduated gel media. The gel is rolled between two spools, and the position of unrolling of the gel determines its color. Such a device is availible from LIGHT AND SOUND DESIGN (™), Birmingham England, under the trademark of WASHLIGHT(™).

Fluorescent light is ideal for large area lighting for many reasons. First of all, fluorescent produce their lights along a relative long line. Fluorescent uniformly produces its lighting effect along that long line. This compares to many other lights which are essentially point sources. However, the fluorescent lights often dim poorly.

SUMMARY

Solid-state ballasts for fluorescent lamps are now available which allow fluorescent lamps to be dimmed between ten percent and ninety percent of their full output brightness. In addition, such solid-state ballasts often more efficiently drive the fluorescent lamp, to minimize any high frequency flickering effect.

This invention describes using primary-colored flourscent bulbs, and selectively dimming those bulbs to form a desired color effect.

DESCRIPTION OF THE PREFERRED EMBODIMENTS

Figure 1:
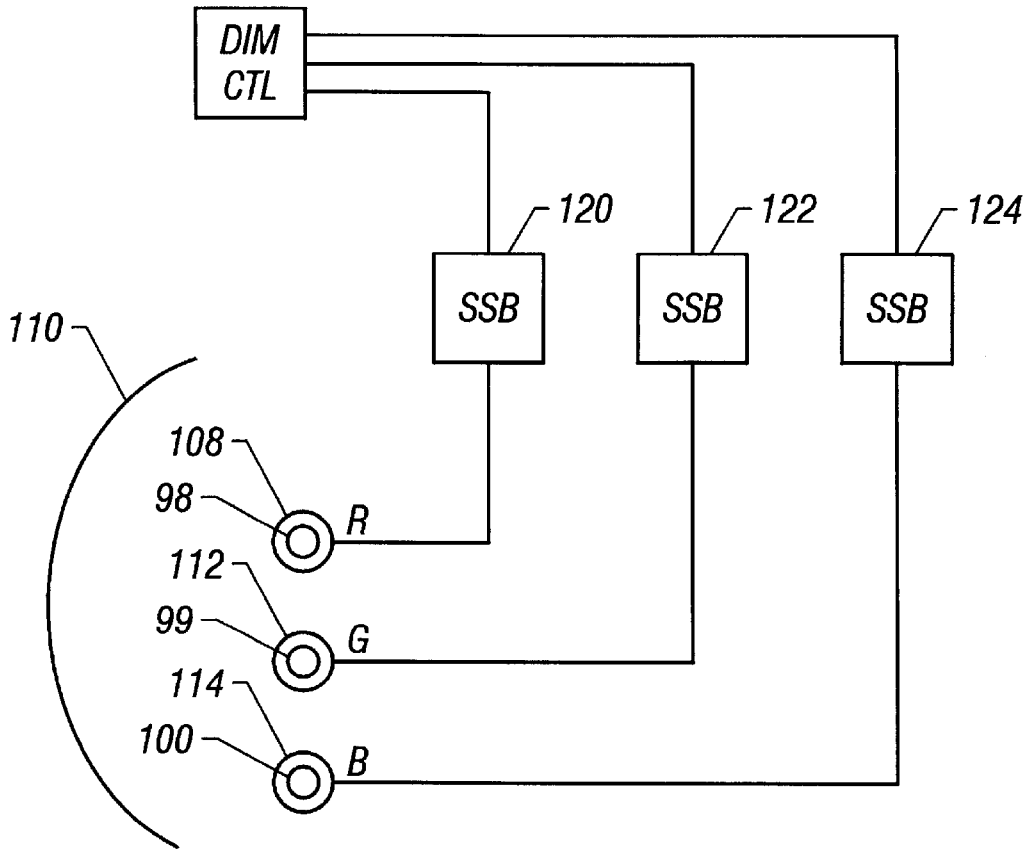
FIG. 1 shows a first embodiment which places encapsulite-covered flourescent bulbs in a straight line with a single reflector.

The embodiment of this invention forms a variable color fluorescent backlighting device. The embodiment is shown in FIG. 1. Three fluorescent tubes 98, 99 and 100, preferably cylindrical four foot or 8 foot flourescent bulbs, are mounted in appropriate fluorescent sockets within a fluorescent reflector 110. The fluorescent tubes and reflectors are of a conventional type. The fluorescent tube 98 is driven by solid-state ballast 120, fluorescent tube 99 is driven by solid-state ballast 122 and fluorescent tube 100 is driven by solid-state ballast 124. Of course, all the operations could all be done using a single solid-state ballast so long as that ballast allows for separate control of dimming of each of the fluorescent lamps.

Each of the lamps produces a different primary color. This can be done by using different colored lamps. The illustrated embodiment covers each lamp with an encapsulite shield 108, 112, 114. The encapsulite shield is a polycarbonate sleeve. The encapsulite sleeves are available in various colors. The fluorescent lamp 98 is covered by red encapsulite sleeve 108. The lamp 99 is covered by green encapsulite sleeve 112, and the lamp 98 is covered by blue encapsulite sleeve 114. Each of these encapsulite sleeves performs a filtering function, allowing predominantly the specific color wavelengths to be projected. This produces an effect simulating red, green and blue light. Each of the lamps is also independently controllable via the respective solid-state ballast. This allows mixing the primary colors in any desired way.

The three lights are clustered in proximity in order to provide additive mixing of the colors from the three lights. If the lights were not closely located relative to each other, the effect could produce shadows of different colors. Therefore, it is preferable for the lights to be provided sufficiently close to one another to avoid different colored shadows being produced. Preferably, the devices are co-located as a semi-point source, located with the point at the focal point of the reflector 110.

Figure 2:
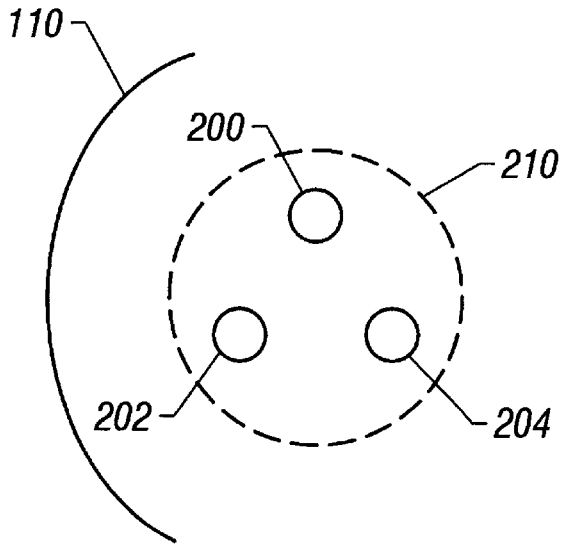
FIG. 2 shows a second embodiment with colored flourescent bulbs in triangular pattern.

The second embodiment shown in FIG. 2 places the three is bulbs in a substantially triangular pattern to better simulate the point source effect. The three bulbs 200, 202, and 204 in the FIG. 2 embodiment are respectively of different colors. All are generally located within the focal point 210 of the reflector 110.

The resultant device, therefore, includes a red fluorescent tube, a green fluorescent tube, and a blue fluorescent tube. The colors from the tubes, in operation, will mix according to their brightnesses to form a desired color lighting effect. Any desired color can be obtained by combinations according to the so-called CIE chromaticity chart. For example, a pink color can be formed by a combination of blue, red, and green. The relative brightnesses of the colored lights are adjusted to provide 100% red, 50% blue, and just a little (25%) green. The absolute brightness of the pink color can be adjusted by adjusting the absolute brightness of the lamps while maintaining the ratios between the colors. For example, therefore, a dimmer effect with pink light could use 10% green, 20% blue, and 40% red.

By control of these two parameters: the relative brightness of the primary colors and the absolute brightness of the primary colors, any desired color and brightness within the available brightness output of the fluorescent tubes can be obtained.

Since this effect is produced by a fluorescent system, a number of advantages are obtained, including increased bulb life, color spread over a longer length, and lower cost. The light also produces a different effect than is obtained from incandescent light.

The present invention contemplates use with either standard fluorescent fixtures, or high output ("HO") or very high output ("VHO") fluorescent lamps to produce greater light amounts.

Other embodiments are within the disclosed elements. For instance, although only a few different color combinations are disclosed, it should be apparent that anyone of ordinary skill in the art of color mixing would understand how to form any desired color from red, green and blue combinations. The present invention describes use with a solid-state ballast, but it should be understood that any ballast which allows relative dimming of the lamps could alternately be used. Other primary colors, e.g., cyan, magenta, and yellow could alternately be used.

What is claimed is:

1. A fluorescent backlighting system, comprising:

a light reflector having a curved reflective surface that has a focus position;

a plurality of fluorescent lighting devices disposed in close proximity with each other near said focus position of said curved reflective surface, said fluorescent lighting devices including at least a first fluorescent lighting device which produces a first primary color and a second fluorescent lighting device which produces a second primary color;

a solid state fluorescent ballast, controlling relative brightness outputs of said first and second fluorescent devices, and dimmable to change an output of light output of said first and second fluorescent lighting devices; and a dim control device, connected to said solid state ballast and controlling said outputs of said solid state ballast to allow turning on said first fluorescent device at a higher brightness output than said second fluorescent device to thereby enable different colors to be produced.

2. A system as in claim 1, wherein said fluorescent lighting devices are cylindrical bulbs.

3. A system as in claim 1, further comprising a third fluorescent lighting device, having a different color output than said first and second fluorescent lighting devices, and where said ballast and said dim control device each also control said third flourescent lighting device.

4. A system as in claim 3, wherein said first, second and third flourescent lighting devices are respectively primary colors.

5. A system as in claim 3, wherein said first, second and third flourescent lighting devices are red, green and blue.

6. A flourescent lighting system, comprising:

first, second and third flourescent bulbs, each having a different color light output, and located in an area;

a light reflector having a single reflective surface and positioned relative to said fluorescent bulbs to have a focus position of said reflector in said area, collectively reflecting said light from said area to produce a light output which sums light output from said first second and third bulbs;

first, second and third dimmable flourescent ballast parts, each respectively driving one of said flourescent bulbs, and each separately controllable to change an amount of light output from each of said bulbs, to allow any color, and any intensity output, to be produced.

7. A method of flourscent lighting, comprising:

obtaining first, second and third flourescent bulbs, respectively having first, second and third colors, and a light reflector having a focus position, collectively reflecting said light from said bulbs to produce a light output which sums light output from said first second and third bulbs;

arranging said first, second, and third flourescent bulbs in a close proximity of said focus position;

determining a desired light color to be output, and determining a ratio between said first, second and third colors to produce said desired light color;

determining a desired light intensity to be output;

using three dimmable flourescent ballasts to drive said first, second and third bulbs at said ratio and at said desired light intensity.

8. A system as in claim 3, wherein said first, second, and third fluorescent lighting devices are arranged in a triangular geometry.

9. A system as in claim 6, wherein said first, second, and third fluorescent bulbs are arranged in said area to form a triangular geometry.

10. A method as in claim 7, further comprising arranging said first, second, and third fluorescent bulbs in said area to form a triangular geometry.

* * * * *